US011674309B2

(12) United States Patent
Simonic

(10) Patent No.: US 11,674,309 B2
(45) Date of Patent: Jun. 13, 2023

(54) CONNECTING ELEMENT FOR A NON-BEARING WALL STRUCTURE TO ALLOW A SLIDING COMPENSATION MOVEMENT

(71) Applicant: KNAUF GIPS KG, Iphofen (DE)

(72) Inventor: Boris Simonic, Rijeka (HR)

(73) Assignee: KNAUF GIPS KG, Iphofen (DE)

( * ) Notice: Subject to any disclaimer, the term of this patent is extended or adjusted under 35 U.S.C. 154(b) by 0 days.

(21) Appl. No.: 16/615,100

(22) PCT Filed: Jun. 1, 2017

(86) PCT No.: PCT/EP2017/000639
§ 371 (c)(1),
(2) Date: Nov. 19, 2019

(87) PCT Pub. No.: WO2018/219419
PCT Pub. Date: Dec. 6, 2018

(65) Prior Publication Data

US 2020/0173169 A1 Jun. 4, 2020

(51) Int. Cl.

| | |
|---|---|
| ***E04B 2/76*** | (2006.01) |
| ***E04B 1/41*** | (2006.01) |
| ***E04H 9/02*** | (2006.01) |
| ***E04B 1/38*** | (2006.01) |

(52) U.S. Cl.
CPC ..... *E04B 2/768* (2013.01); *E04B 1/40* (2013.01); *E04H 9/021* (2013.01); *E04B 2001/405* (2013.01)

(58) Field of Classification Search
CPC ..... E04B 2/768; E04B 1/40; E04B 2001/405; E04B 2/825; E04B 1/5818; E04H 9/021
See application file for complete search history.

(56) References Cited

U.S. PATENT DOCUMENTS 2,611,160 A * 9/1952 Antonin ..... A63H 33/107 182/228.1
3,907,445 A * 9/1975 Wendt ..... F16B 9/058 403/191
4,449,335 A * 5/1984 Fahey ..... E04B 1/2612 52/713

(Continued)

FOREIGN PATENT DOCUMENTS

WO 03/102321 A1 12/2003

OTHER PUBLICATIONS

International Search Report and Written Opinion from International Patent Application No. PCT/EP2017/000639, dated Feb. 22, 2018.

*Primary Examiner* — Brian D Mattei
*Assistant Examiner* — Omar F Hijaz
(74) *Attorney, Agent, or Firm* — Greer, Burns & Crain, Ltd

(57) ABSTRACT

A connecting element is provided for connecting an essentially vertically arranged or arrangeable upright for a non-bearing wall structure with an essentially horizontal bar, in particular a steel profile with a U-shaped cross section, preferably a ceiling profile, to allow a sliding compensation movement in essentially the vertical direction, and with at least one fastening section for fastening to the bar or the preferable ceiling profile of a load-bearing or non-loading-bearing ceiling structure and with a least one sliding guide for the upright.

5 Claims, 9 Drawing Sheets

(56) References Cited

U.S. PATENT DOCUMENTS

| | | | | | |
|---|---|---|---|---|---|
| 4,572,695 | A * | 2/1986 | Gilb | F16B 9/052 | 403/232.1 |
| 5,040,345 | A | 8/1991 | Gilmour | | |
| 5,217,317 | A * | 6/1993 | Young | F16B 9/058 | 403/232.1 |
| 5,596,859 | A * | 1/1997 | Horton | E04B 2/7453 | 52/481.1 |
| 5,625,995 | A | 5/1997 | Martin | | |
| 5,797,694 | A * | 8/1998 | Breivik | F16B 9/058 | 403/231 |
| 6,430,890 | B1 * | 8/2002 | Chiwhane | E04B 1/2403 | 52/655.1 |
| 6,523,321 | B1 | 2/2003 | Leek et al. | | |
| 7,559,519 | B1 * | 7/2009 | Dragic | E04B 2/7457 | 248/216.1 |
| 10,087,617 | B2 * | 10/2018 | Daudet | E04B 2/96 | |
| 2002/0170260 | A1 | 11/2002 | Wheeler et al. | | |
| 2012/0266545 | A1 * | 10/2012 | diGirolamo | E04B 1/38 | 52/98 |
| 2017/0204600 | A1 * | 7/2017 | Daudet | E04B 1/2403 | |

* cited by examiner

CONNECTING ELEMENT FOR A NON-BEARING WALL STRUCTURE TO ALLOW A SLIDING COMPENSATION MOVEMENT

BACKGROUND

The invention relates to a connecting element for connecting an essentially vertically arranged or arrangeable upright for a non-bearing wall structure with an essentially horizontal bar, in particular a steel profile with a U-shaped cross section, preferably a ceiling profile, to allow a sliding compensation movement in essentially the vertical direction, and with at least one fastening section for fastening to the bar or the preferable ceiling profile of a load-bearing or non-loading-bearing ceiling structure and with a least one sliding guide for the upright.

Such a kind of connecting element is known in principle from U.S. Pat. No. 5,040,345.

The connecting element known from this document is essentially U-shaped and can be inserted with its U-shaped end into a U-shaped ceiling profile up to is U profile cross-piece, i.e. against the ceiling so that the connection element with the U-profile shape is arranged at right angles, therefore vertically in relation to the ceiling profile with the U-shape. The upper end of the vertical upright can be pushed onto the U-shape of the connecting element in sliding manner, or the U-shape can be slid into the upper end of the upright. The free outermost end sections of the U-flange of the U-profile of the connection element can be screwed to the U-flanges of the ceiling profile so that it is secured against horizontal displacement in the ceiling profile. In contrast the downward facing width of the U-flange of the connecting element forms a vertical sliding path for the upper end of the upright which can therefore move a corresponding distance from the U-cross-piece of the ceiling profile without becoming entirely free of the connecting element at the bottom. For form-fitting sliding of the upright profile, the U-flanges of the connecting element have guide paths in the form of pleats which can positively engage in the free longitudinal edge of a C-profile of the upright. The form fit thus prevents horizontal movement of the upright while still allowing a vertical movement. The C-shaped upright profile partially surrounds the connecting element with the U-profile. However, as the connecting element sits in the U-profile of the ceiling profile and the upper end of the upright should also project into the U shape of the ceiling profile, this produces confined spatial conditions and complicated labyrinth guides which make it difficult to implement what has been set out in the cited documents and results in very small manufacturing tolerances and difficult assembly.

The invented connecting element is in particular intended for dry wall construction in which non-bearing upright partition walls are produced with board materials, preferably with plasterboards, gypsum fibreboard, cement panels, wooden composite boards. In the case of ceiling deflections, connecting elements are used as sliding ceiling connections in order to connect ceiling profiles with upright profiles in such a way that vertical movement and changes in distance between the upper ends of the uprights and the "U" ceiling profiles are made possible and tolerated without the connection between the uprights and ceiling profiles loosening completely and the uprights no longer being fixed with their upper ends in the horizontal direction which would result in preventable instability of the wall itself. Ceiling profiles and/or upright profiles can bend, especially in the event of fire or great heat, or shocks, such as earthquakes or other shaking, i.e. dynamically. In such cases the secure connection between the ceiling and wall should remain in order to avoid damage or even injury to persons, and in the event of fire to prevent the spread of the fire for as well as as long as possible.

SUMMARY

The aim of this invention is to provide a connecting element of the type stated above that allows a sliding ceiling connection to be produced on the basis of the above considerations and for the described reasons in a particularly elegant and simple manner.

The invention achieves this aim in that at least one sliding guide is designed and provided to at least partially surround the cross-section of the upright on the outside.

In this way the connecting element according to the invention allows the upright to be guided in it in a particularly advantageous and surprisingly simple way and can also penetrate into a downwardly open ceiling profile or into another horizontal bar until it comes to a stop and at the same time the invented connecting element can prevent a horizontal movement of the upright. This results in a particularly secure and stable non-bearing wall structure that is nevertheless simple to produce and assemble. The said upright could also be called a stud and the said horizontal bar might be called a whaler.

In particular, the sliding guide grips the upright from the outside so that the upright itself can be positioned without hindrance but still be guided securely.

A further development of the invention envisages that the sliding guide has a back that can preferably be applied to the upright over the width of the upright and a guide element at least partially surrounding the upright cross-section from the back. This results in a particularly effective inventive solution and can also save materials. For this a further development of the invention preferably envisages that the back and/or the guide element is/are essentially flat. In a preferred form of embodiment the back can be designed as a tab on the fastening section from which the guide element projects as a tongue.

A further development of the invention envisages that there are least two guide elements jointly surrounding the upright cross-section on both sides. Through this the sliding guide can be made particularly secure and stable as any force-absorbing arms can be kept relatively short.

A preferred form of embodiment of the invention is characterised in that the fastening section is essentially flat. Through this the fastening section can have at least one fastening flange and can be fastened to a flange on the ceiling profile particularly easily.

For particularly secure and also flexible fastening, the fastening flange can have at least two fastening ears which can be arranged in one plane or also in different planes, aligned in parallel or at an angle to each other. In particular the two fastening ears are arranged plane parallel to each other at the distance of the shanks or flange of a ceiling profile to which they are to be fastened.

Another, independent and also in itself inventive solution to the set task is characterised by two slide guides provided for the joint guiding of the same upright ("single connector, bilateral") or for guiding uprights where are immediately adjacent to each other ("double connector, uni- or bilateral"). In this way a double sliding guide can be provided which surrounds an upright more securely and/more spaciously or can grasp and fix a double upright.

Preferably the invented connecting element having two sliding guides or sliding guide areas can be designed mirror symmetrically for its sliding guides.

In a preferred solution this can be achieved in a particularly refined manner which also saves materials and can be very simply set up in a precisely fitting way can be achieved in that the fastening section is mirror symmetrical and in that the fastening ears of one half of the fastening section merge into the fastening ears of the other mirrored half of the fastening section. During production, for example, at least one opening can be provided which leaves the fastening ears connected to each other.

In production terms it can preferably be envisaged that at least one of the various areas of the connecting element is bent with regard to an adjacent area so that production of the required spatial shape, particularly taking into account the profile form to be guided, can be produced quickly and cost-effectively with simple tools and in large numbers, but at the same time in one piece and stably.

In a double (bilateral) embodiment of the sliding guide of the connecting element according to the invention the fastening section can overall be stably formed as a bridge preferably U-shaped in profile between the sliding guides.

According to the invention it can simply and cost-effectively be envisaged to produce the connecting element essentially from a metal sheet or other suitable flat material and preferably for the connecting element to punch out a cut-out from a metal sheet or suitable flat material.

Overall it can be advantageously envisaged that at least one otherwise standardised sliding guide can be adapted to different upright cross-section thicknesses or sizes in that it more spaciously surrounds thinner cross-sections than thicker ones.

A preferred form of embodiment of the invented connecting element is characterised in that the fastening section is designed and provided for fastening to a U-profile bar preferably at at least one of its U-shanks or U-flanges and preferably on its profile inner side and/or that at least one sliding guide is designed and envisaged for the slide guiding of a C-profile shaped upright. In the latter case guide elements could penetrate into the interior of the C profile and grasp the ends of the C shape in a form-fit manner. Through this the upright is guided particularly securely like in a rail in the sliding guide.

A further development of the invention is characterised in that the at least one sliding guide or a least one of the sliding guides set up for sliding fastening is arranged on the upright in order to additionally secure the grip of the sliding guide. It can be preferable for the sliding guide to have a least one guide slot or an elongated hole for taking up a guide bolt, preferably designed as a fastening element.

To solve the set task the invented connection element could provide a sliding guide path of at least 10 mm, preferably 10 mm to 100 mm. Such a guide path should be sufficient and appropriate for most of the described problems. This can also be produced easily and such a connecting element can be assembled without problems.

BRIEF DESCRIPTION OF THE DRAWINGS

Examples of embodiment from which further inventive features can derived but which should only be considered as examples and should not restrict the subject matter of the invention or its protective scope are shown in the drawing. In this.

DETAILED DESCRIPTION

Figure 1:
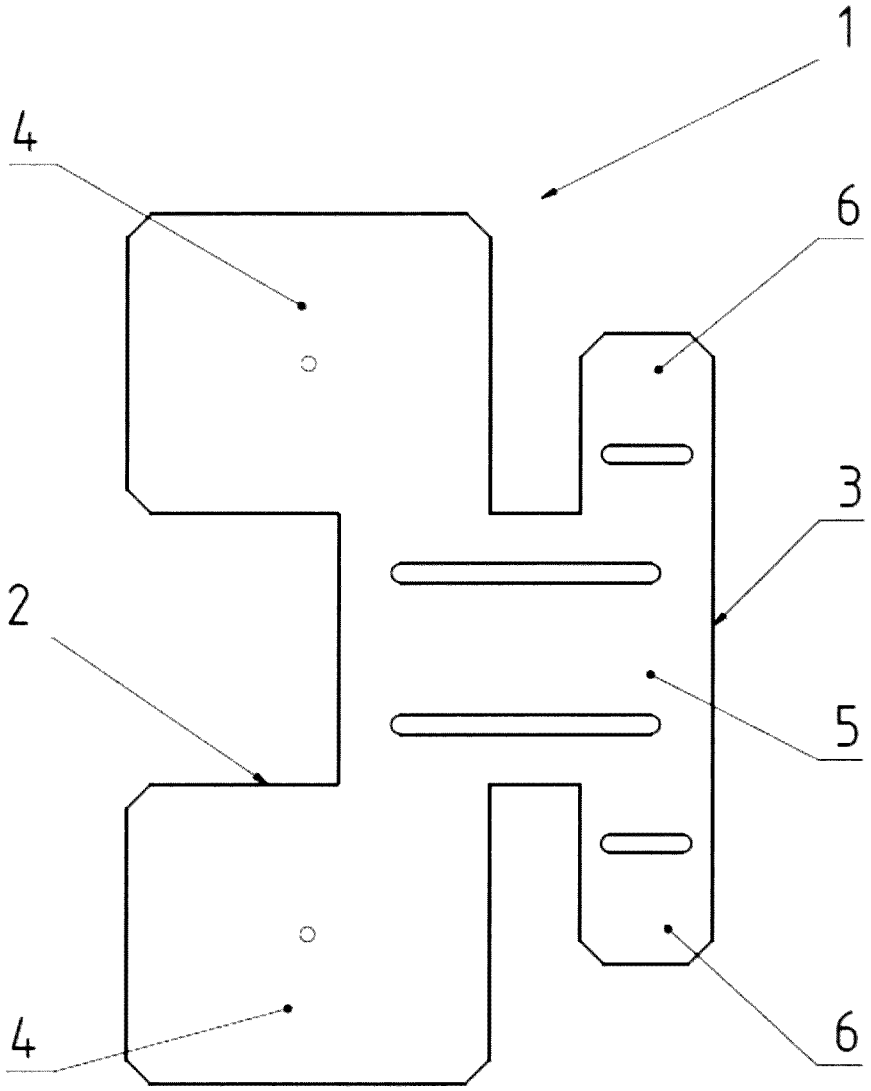
FIG. 1 shows a cut-out for a first example of embodiment of an invented connecting element.

FIG. 1 shows a cut-out for a first example of embodiment of a invented connecting element 1. This cut-out can be punched out of a metal sheet for example.

The invented connecting element 1 has a fastening part or fastening section 2 which is intended for fastening to an essentially horizontal bar, in particular a ceiling profile 10. The connecting element 1 also has at least one sliding guide 3 which cannot yet be seen very clearly in FIG. 1, but is initially only present as a further section of the cut-out.

The fastening part 2 has two fastening ears 4.

The sliding guide 3 is made up of a back 5 and two guide elements 6 projecting therefrom. Here the guide elements are designed as tongues.

At this point it should be mentioned that the connecting element 1 does not necessarily have to be made of a cut-out from a metal sheet, but can be suitably already provided as a three-dimensional body. However, production from metal sheet is possible very cost-effectively, efficiently and at the same time precisely in terms of size.

Figure 2:
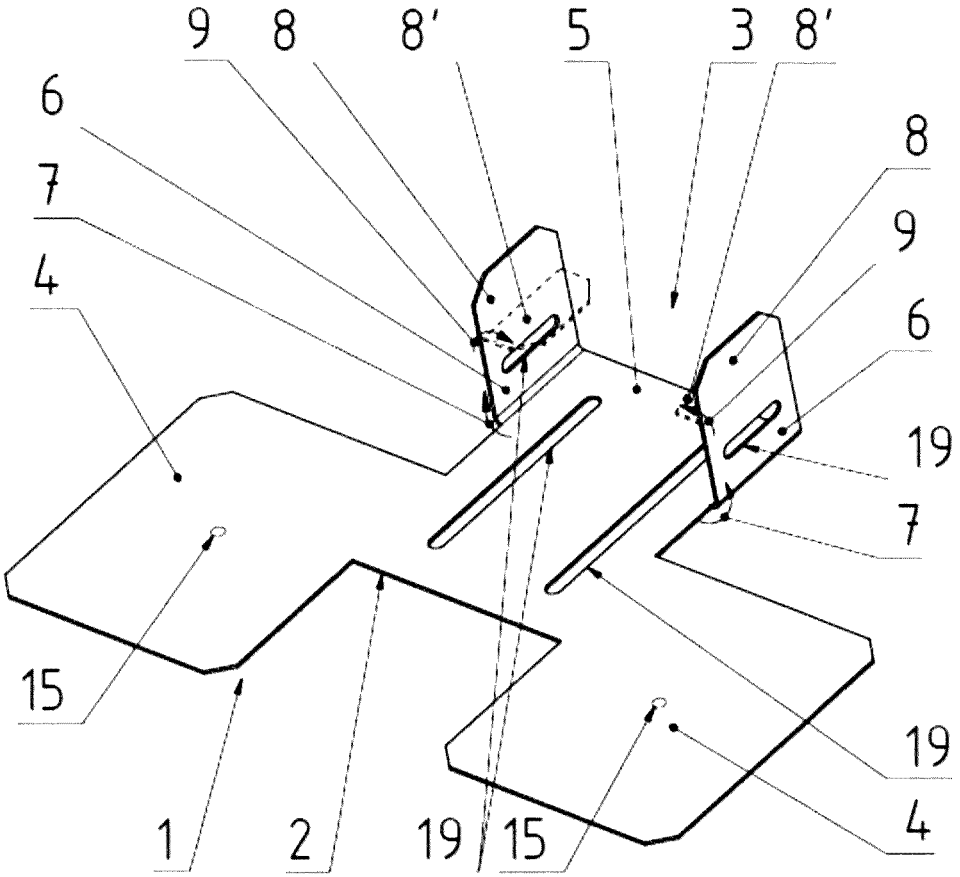
FIG. 2 shows the connecting element in FIG. 1 in a bent, perspective view.

FIG. 2 shows a perspective view of the connecting element in FIG. 1 in its functional form. As in the other figures identical components are given the same reference numbers as in FIG. 1.

In FIG. 2 the slide bearing 3 formed by the back 5 and the guide elements 6 can be seen in functional terms as can the fastening part 2 with its fastening ears 4.

To form the sliding guide 3 the tongue-shaped guide elements 6 have been bend by around 90 degrees from the back 5 in the direction of the arrows 7. Depending on the spatial conditions of an upright to be encompassed, at least one end section 8 of the guide elements 6 could be bend further in the direction of the arrows 9 until it has reached the position 8' indicated by the dashed line.

Figure 3:
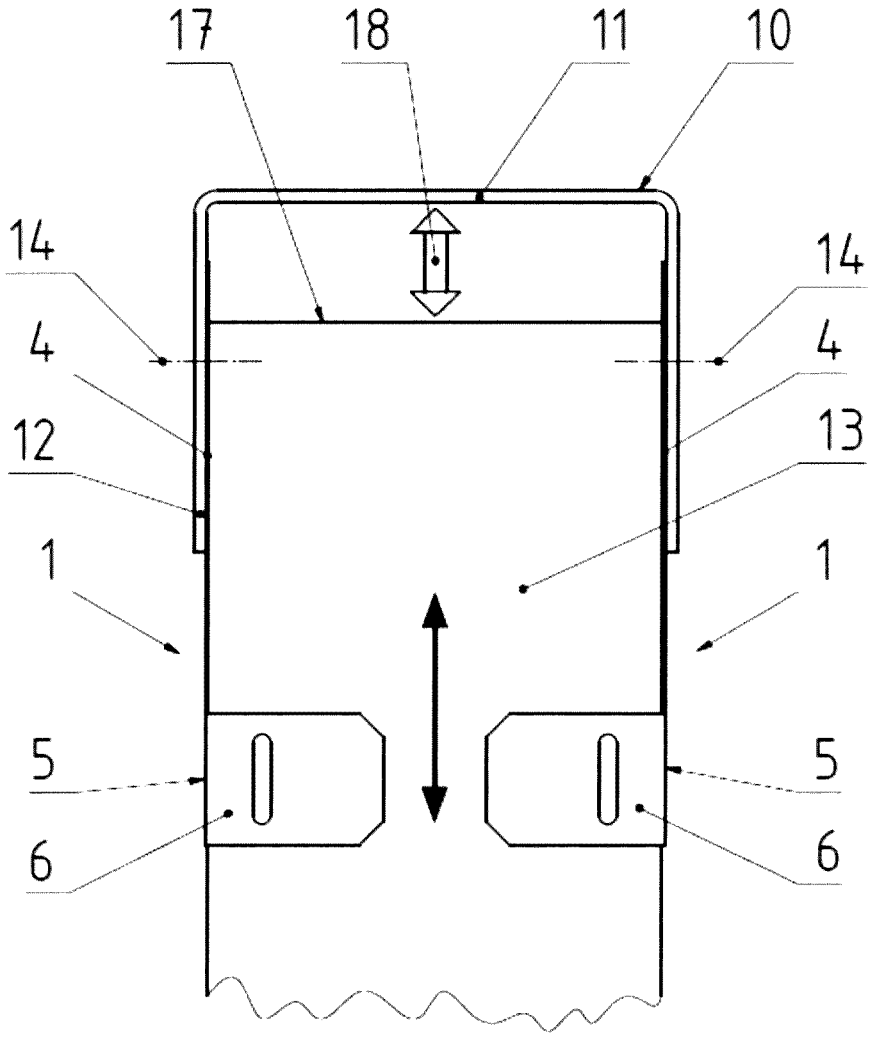
FIG. 3 shows two connecting elements from FIGS. 1 and 2 applied to an upright for the sliding connection of the upright with a ceiling profile shown in cross-section.

FIG. 3 shows two connecting elements 1 according to FIG. 2 in function.

In FIG. 3 a cross-section of a ceiling profile 10 with a U-profile is shown. The ceiling profile 10 has a cross-piece 11 and shanks or flanges 12. This ceiling profile 10 extends essentially horizontally on a ceiling which is not shown in more detail. Instead of a ceiling profile 10 this could also be any other essentially horizontal bar extending for example at a distance from a ceiling more in the middle of an upright or wall frame.

The upper end of an essentially vertically aligned upright 13 is introduced from below into the shown ceiling profile 10.

In FIG. 3, connections elements 1 according to the invention in the form of in FIG. 2 are inserted on the right and left of the upright 13 between the upright 13 and the flange 12 of the ceiling profile 10.

The fastening ears 4 of the connecting elements 1 are each attached to a flange 12 of the ceiling profile 10 by way of fastening elements 14 which are not shown and are only indicated by the dashed line. The fastening elements 14 can be positioned in front of and/or behind the plane of the drawing so that they do not disturb the upright 13. Simply for the sake of clarity holes 15 for the fastening elements 14 in the fastening ears 4 are indicated in FIG. 2.

The guiding elements 6 bent from the back 5 of the connecting element 1 each partially grip around the upright 13 from the left and right and thus form two sliding guides 3 or one large joint sliding guide. The upright 13 is guided in a sliding manner in these sliding guides 3 so that it can move in the direction of the essentially vertical double arrow 16 relative to the ceiling profile 10 and so that the ceiling profile 10 can move relative to the free upper end face 17 of the upright 13 as indicated with the double arrow 18. Preferably a movement space or sliding path of around 10 mm to 100 mm can be provided, which ultimately can be predetermined and set with the dimensioning of the connecting element 1 and the arrangement and position of the guiding elements 6, in that the upright 13 is guided over a certain movement path in the sliding guide 3 without its upper end face 17 entirely coming out of the sliding guide 3.

As also indicated in FIG. 2, elongated holes can be provided in the back and/or in the guiding elements 6 into each of which a guide bolt to be attached to the upright 13 can engage so that here the sliding path is limited and the sliding guide is additionally secured on the upright 13 or vice-versa the upright 13 in the sliding guide 3.

Through the fastening elements and for form fitting of the sliding guide 3 it is ensured that the upper end of the upright 13 cannot move horizontally along the ceiling profile 10. Overall the upright 13 is therefore (vertically) fastened in a sliding manner in the ceiling profile 10.

As will be explained in more detail in connection with FIG. 4 the fastening parts 2, i.e. the fastening ears 4 of the two connecting elements 1 can also be connected to form a connecting element 1 according to the invention (in accordance with the example of embodiment in FIG. 4). Such a connection 20 (see FIG. 4) can connect the fastening ears 4 in a bridge-like manner to each other in parallel to the cross-piece 11 of the ceiling profile 10. In this way a connection element 21 with sliding guides 3 for upright 13 on both sides is produced.

Figure 4:
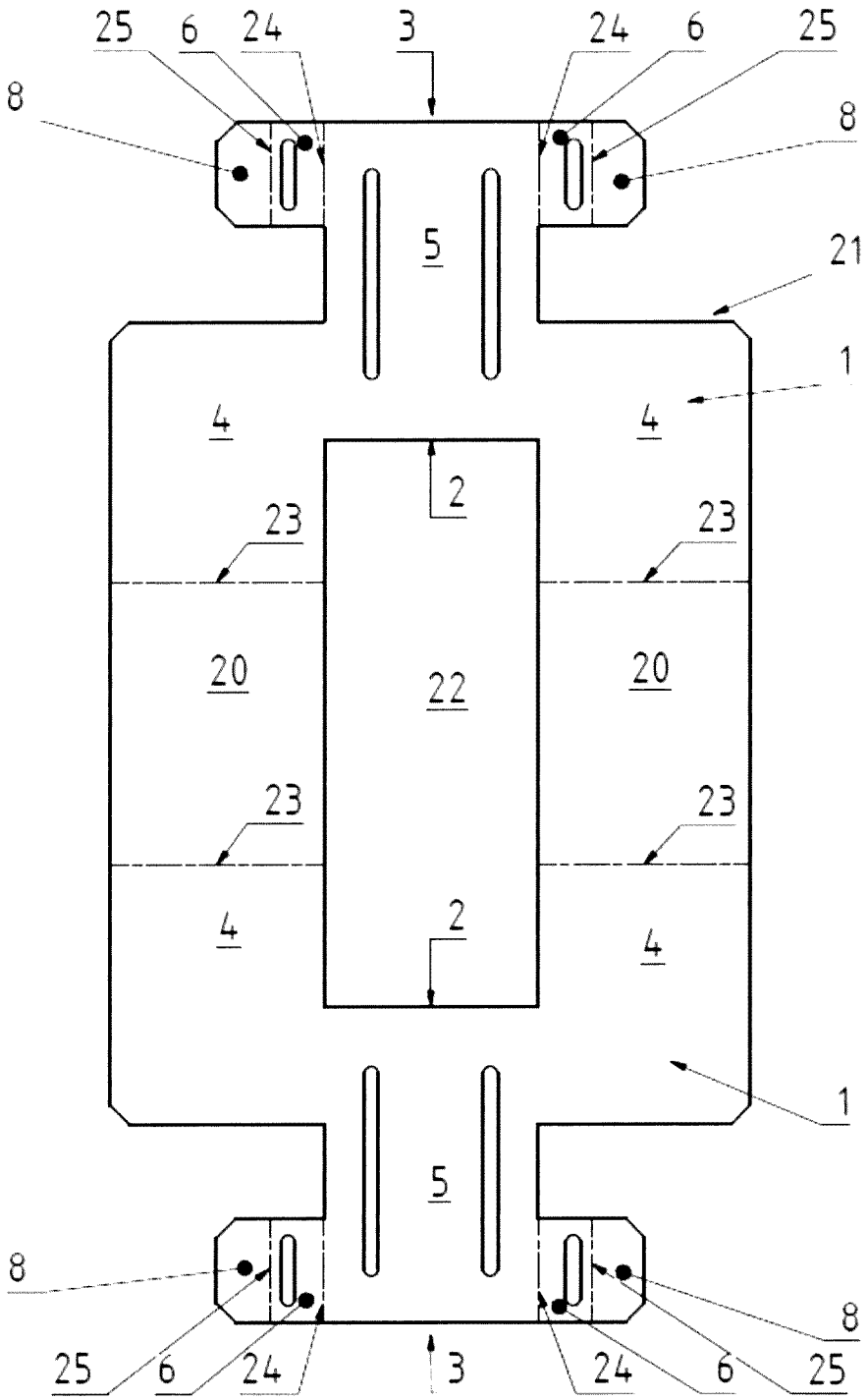
FIG. 4 shows a cut-out of a second example of embodiment of a connecting element for the bilateral sliding guiding of an upright.

FIG. 4 shows the cut-out for an already previously indicated second example of embodiment of a connecting element 21. It essentially comprises two connecting elements 1 which via their fastening ears 4 are connected to each other in a bridge-like manner by way of connections 20 leaving a central opening 22.

In FIG. 4 dashed lines indicate bending lines at which bending can take place but does not necessarily have to.

Along the bending lines 23 the two connecting elements 1 can be bent down in the plane of the drawing so that with the connections 20 in the profile they form a U, which can be introduced into the U-shape of the ceiling profile 10, i.e. in parallel to its cross-piece 11 and flanges 12.

The guiding elements 6 can be bent along the bending lines 24 so that under the U-shape they project inwards to the guiding elements 6 of the other connecting element 1. Depending on the concept, with these they form two sliding guides 3 or one large joint sliding guide for an upright 13. In any case an upright profile can be almost completely surrounded with the two backs and the total of four guide elements 6. At least on one side of the connection element 1, end sections 8 of the guide elements 6 can again be bent along bending lines 25 so that on one side they could engage in the interior of an upright profile.

FIG. 5 again shows the function of connecting elements 1 in another view.

Indicated in a broken off manner with dashed lines is the course of a section of a ceiling profile 10 in a type of longitudinal section along its flange 12.

Shown in the view from above is also the end face 17 of an upright 13 which has been introduced into the ceiling profile 10 from below. In this view it can be seen that the upright has a C-profile with a cross-piece back 26, shanks 27 and end flanges 28.

Figure 5:
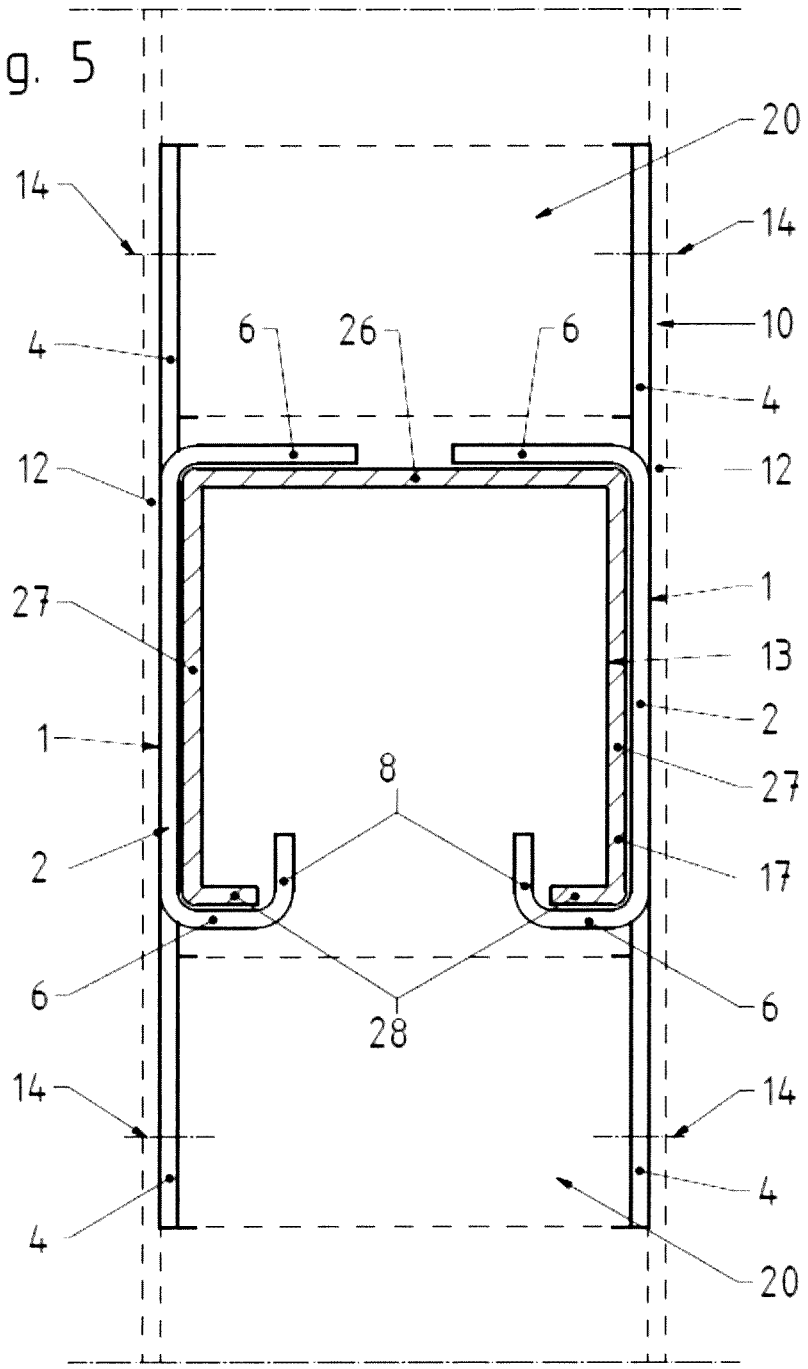
FIG. 5 shows a view from above of the end face of an upright with the applied connecting element according to FIGS. 1 to 3.

Furthermore, in FIG. 5 two connecting elements 1 can be seen which also in accordance with the form of embodiment in FIG. 4 can be connected to each other via connections 20 to form a connecting element 21 with a support and guide for the upright 13 on both sides, as indicated with dashed line. The fastening ears 4 are connected to the flanges 12 of the ceiling profile 10 via fastening elements 14, whereby it can be seen in FIG. 5 that these fastening elements 14 are arranged far outside the area of the upright 13.

In FIG. 5 the shape of the guide elements 6 can be seen for example in the view from above. The guide elements 6 are in flat contact with the back of the cross-piece 26 of the C-profile of the upright 13, while on the opposite side of the upright 13 they have bent end sections 8 which project into the interior of the C-profile of the upright 13 and surround the end flange 28.

At this point, it should be added that the invented connecting element can also be designed and dimensioned so that it can guide two adjacent uprights 13 or a so-called double-upright at the same time. This is more in detail described in the following with FIGS. 6 to 9.

Figure 6:
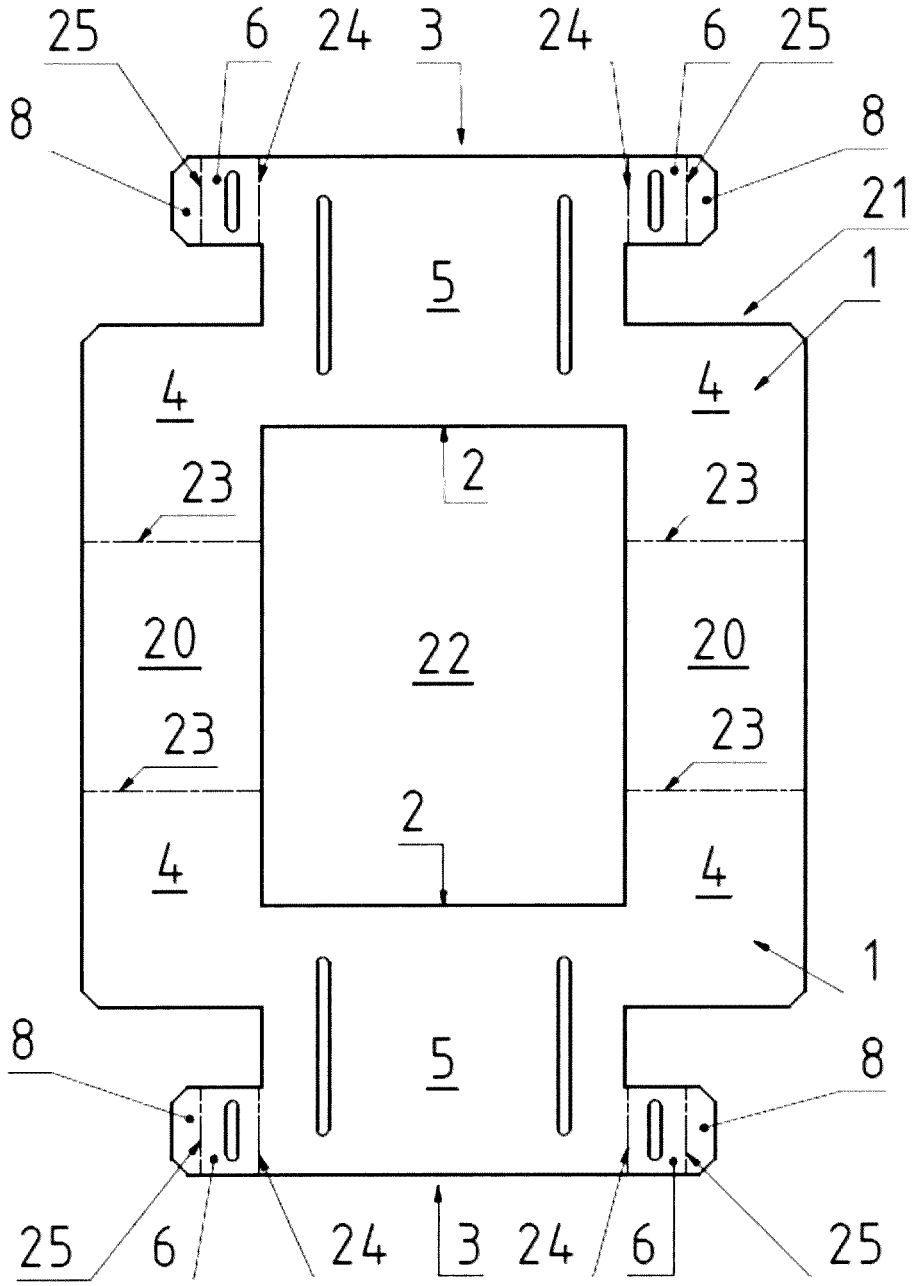
FIG. 6 shows a cut-out similar to the cut-out in FIG. 4 but for a third example of embodiment of a connecting element for the bilateral sliding guiding of two uprights adjacent to each other.

FIG. 6 shows a cut-out similar to the cut-out in FIG. 4 but for a third example of embodiment of a connecting element 21 including two connecting elements 1 for the bilateral sliding guiding of two uprights 13 adjacent to each other. For this purpose, the connecting elements 1 had only to get broader backs 5 to catch the two uprights 13 together. The elements shown in FIG. 6 have the same reference numbers as in FIG. 4.

Figure 7:
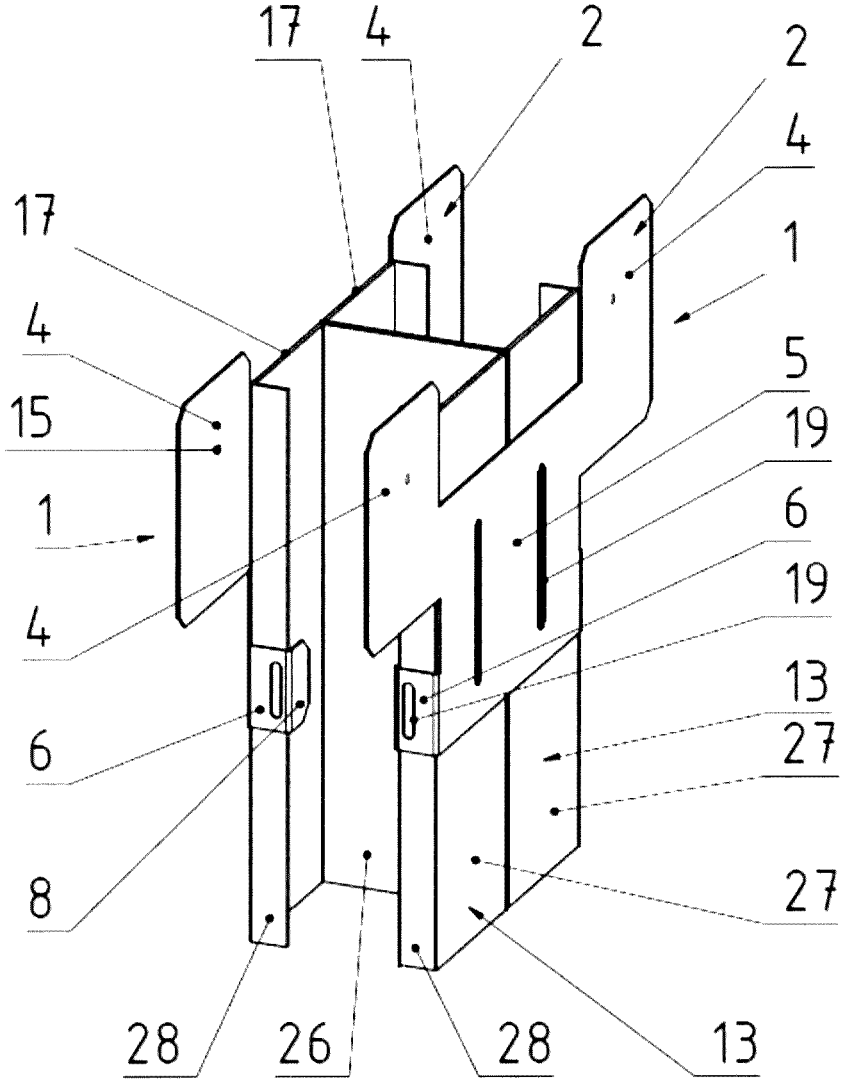
FIG. 7 shows a perspective view of two connecting elements like in FIG. 3 but this time as a forth example of embodiment sliding guiding of two uprights back to back to each other.

FIG. 7 shows a perspective view of two connecting elements 1 like in FIG. 3 but this time as a forth example of embodiment sliding guiding of two uprights 13 back 26 to back 26 to each other. Again, the same elements have the same reference numbers as in the figures before.

Whereby the embodiment of the connecting element 21 is able to guide two uprights 13 on both their sides, i. e. in a bilateral way, the embodiment of the connecting elements 1 are guiding the two uprights 13 single-sided on different sides of the uprights 13. The fastening ears 4 with their holes 15 can be fixed to the flanges 12 of a ceiling profile 10.

Figure 8:
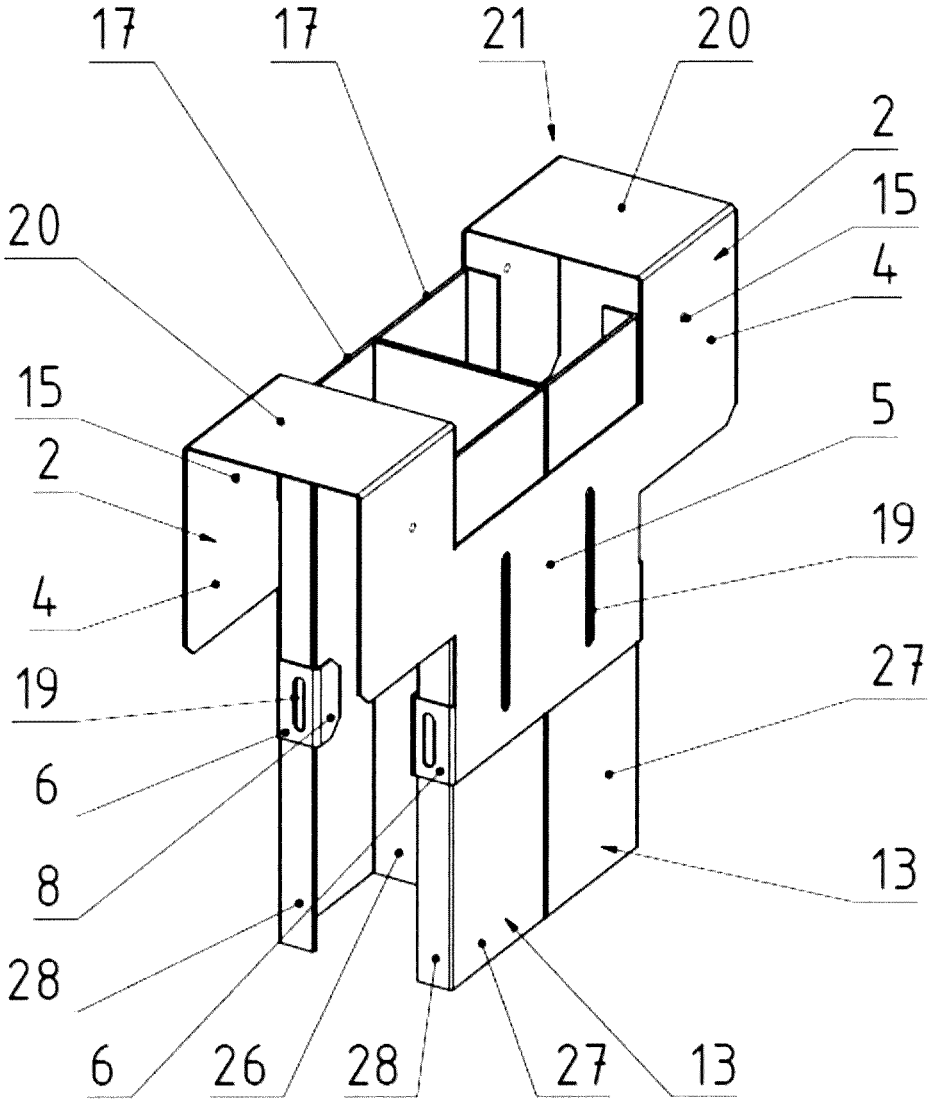
FIG. 8 shows a fifth embodiment of a connecting element in a perspective view for sliding guiding of two uprights back to back to each other and FIG. 9 a perspective view of the embodiment according to FIG. 7 inserted into a ceiling profile.

FIG. 8 shows a fifth embodiment of a connecting element 21 in a perspective view for sliding guiding of two uprights 13 back 26 to back 26 to each other. The view is the same as in FIG. 7 but here a connecting element 21 is shown with connections 20 to connect two connecting elements 1 to each other like bridges to enable the resulting connecting element 21 to guide the two uprights 13 on both their sides in a bilateral way.

Figure 9:
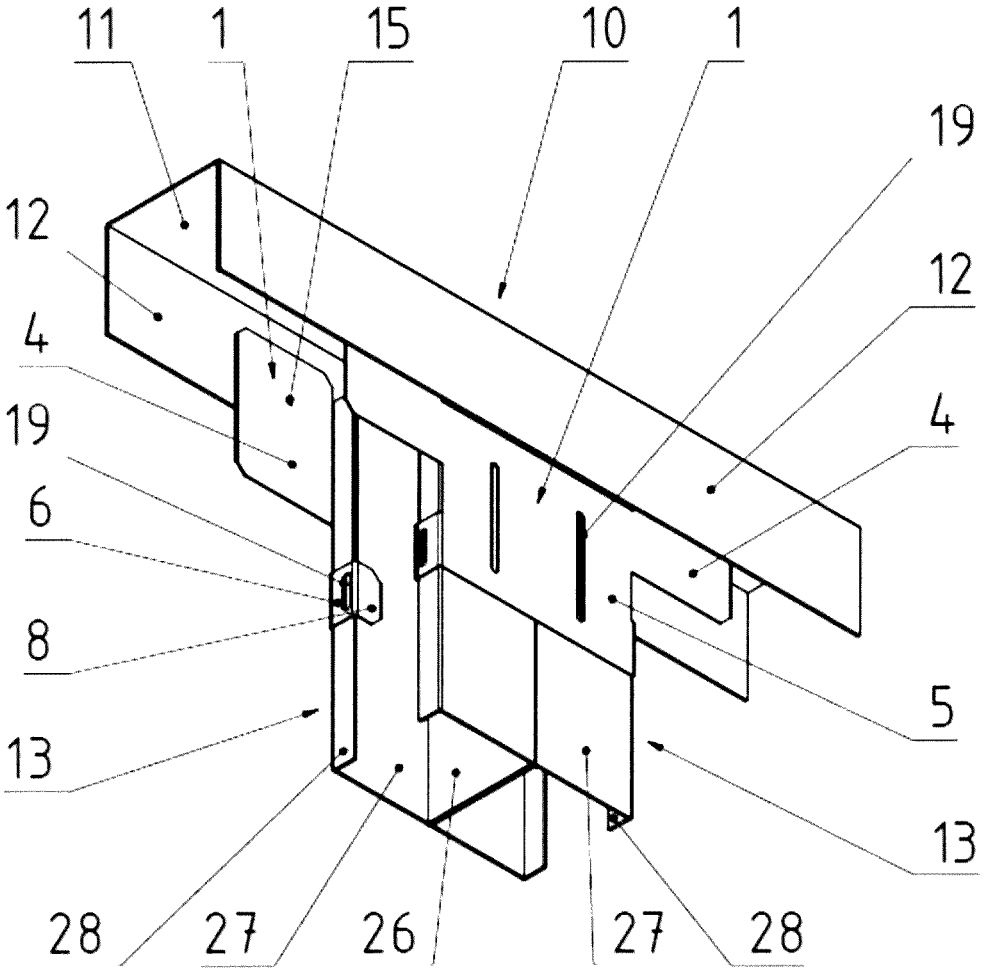

FIG. 9 shows a perspective view of the embodiment according to FIG. 7 inserted into a ceiling profile 10. Looking on the FIG. 9, a multistable perception of the picture has to be avoided by knowing that the picture provides a view into the inner side of the ceiling profile 10 from below. FIG. 9 though provides a good impression of the embodiment according to FIG. 7 in its function with the fastening ears 4 fixed to the flanges 12 of the ceiling profile 10 on the inner sides of the flanges 12.

Essentially (and without being restricted thereto) four versions of an invented connecting element 1, 21 can preferably be provided, namely a "single connector unilateral" according to the connecting element 1 in FIG. 2 for the one-sided guiding of a single upright 13 which would preferably be used in pairs, a "double connector unilateral" provided for the simultaneous but in each case one-sided guiding of a double upright 13 and also preferably used in pairs according to FIGS. 7 and 9, a "single connector bilateral" according to the connecting element 21 in FIG. 4 for the two-sided guiding of a single upright 13 and its larger version the "double connector bilateral" for the simultaneous bilateral guiding of a double upright 13 according to FIGS. 6 and 8.

LIST OF REFERENCE NUMBERS

1 Connecting element
2 Fastening section
3 Sliding guide
4 Fastening ear
5 Back
6 Guiding element
7 Bending arrow
8 End section
9 Bending arrow
10 Ceiling profile
11 Cross-piece
12 Flange
13 Upright
14 Fastening element
15 Hole
16 Double arrow
17 End face
18 Double arrow
19 Elongated hole
20 Connection
21 Connecting element
22 Central opening
23 Bending line
24 Bending line
25 Bending line
26 Upright back
27 Shank
28 End flange

The invention claimed is:

1. A connecting element for connecting an essentially vertically arranged upright for a non-bearing wall structure with an essentially horizontal bar, the connecting element comprising:

at least one fastening section comprising a planar surface and being configured for fastening the connecting element to the horizontal bar, said fastening section having only two flat fastening ears, each said fastening ear including a clarity hole for receiving fasteners for fastening the connecting element to the horizontal bar, said fastening section further including an opening which is coplanar with said planar surface of said fastening section, between said fastening ears such that said opening is defined by inner edges of said fastening ears, a width of said opening being approximately equal to a width of the vertically arranged upright, wherein said fastening ears are coplanar with said planar surface such that said fastening section is defined within a single plane; and at least one sliding guide for guiding the upright;

wherein the connecting element is made in one piece from a metal sheet and the at least one sliding guide is designed and provided to at least partially surround a cross-section of the upright on the outside to allow a sliding compensation movement in the vertical direction;

said sliding guide including at least one guide element, said guide element including an end section which is bent inwardly toward the center of said connecting element, wherein a width of said sliding guide is approximately equal to the width of said opening, and each said fastening ear extends laterally beyond a correspond one of said at least one guide element.

2. A dual connecting element comprising:

two connecting elements according to claim 1.

3. The dual connecting element of claim 2, wherein said dual connecting element includes at least one connnection to connect said two connecting elements.

4. The connecting element according to claim 1, comprising two sliding guides for the joint guiding of the same upright or for guiding an immediately adjacent upright.

5. The connecting element according to claim 4, characterised in that for said sliding guides, the connecting element is mirror-symmetrical.

* * * * *